US005397019A

United States Patent [19]

Schmitt

[11] Patent Number: 5,397,019

[45] **Date of Patent: * Mar. 14, 1995**

[54] VENDING ASSEMBLY

[76] Inventor: Norman L. Schmitt, 2731 Thedford Rd., Bloomfield Hills, Mich. 48304

[ * ] Notice: The portion of the term of this patent subsequent to May 25, 2010 has been disclaimed.

[21] Appl. No.: 66,548

[22] Filed: May 24, 1993

[51] Int. Cl.[6] ..... G07F 11/02

[52] U.S. Cl. ..... 221/130; 221/132; 403/349; 411/372; 411/553; 248/309.1; 248/552; 297/188.1; 297/217.1

[58] Field of Search ..... 221/119, 130, 131, 132, 221/154, 155, 213, 232, 283, 284, 199; 70/58, 62, DIG. 41; 403/319, 348, 349, 378; 411/320, 349, 363, 364, 373, 429, 549, 550, 551, 552, 553, 372; 248/551, 552, 917, 674, 309.1, 200, 346; 297/188, 194, 217; 220/23, 23.86, 83, 908

[56] References Cited

U.S. PATENT DOCUMENTS

| | | | |
|---|---|---|---|
| 3,373,900 | 3/1968 | Staley | 221/199 |
| 3,390,753 | 7/1968 | Bolen et al. | 221/284 X |
| 3,722,745 | 3/1973 | Gushi et al. | 221/130 |
| 4,143,792 | 3/1979 | Rex | 221/199 X |
| 4,391,204 | 7/1983 | Mitchell et al. | 70/DIG. 41 |
| 4,544,081 | 10/1985 | Voegeli | 221/155 |
| 4,643,313 | 2/1987 | Robson | 221/119 X |
| 4,804,107 | 2/1989 | Bergstedth | 221/154 X |
| 4,845,484 | 7/1989 | Ellsberg | 221/154 X |
| 4,869,395 | 9/1989 | Rubbmark | 221/131 |
| 4,919,250 | 4/1990 | Olson et al. | 194/350 X |
| 5,082,101 | 1/1992 | Baker et al. | 194/350 |
| 5,123,551 | 6/1992 | King | 221/155 X |
| 5,213,233 | 5/1993 | Schmitt | 221/130 |

*Primary Examiner*—Robert P. Olszewski
*Assistant Examiner*—Dean A. Reichard
*Attorney, Agent, or Firm*—Alex Rhodes

[57] ABSTRACT

A vending assembly for vending at least one paper from at least one publisher includes a mounting frame forming an architectural landscape form providing a plurality of spaced mounting locations. The assembly also includes a plurality of vending boxes each being located at a corresponding one of the mounting locations and spaced from each other. The assembly further includes a structure for mounting each one of the vending boxes to each one of the mounting locations.

4 Claims, 6 Drawing Sheets

VENDING ASSEMBLY

BACKGROUND OF THE INVENTION

1. Field of the Invention

The present invention relates generally to a vending assembly, and more particularly, to a vending assembly for vending a plurality of papers such as newspapers from a plurality of publishers.

2. Description of the Related Art

Currently, vending machines, boxes or racks are provided to vend or dispense a plurality of papers such as newspapers from different publishers. The vending racks are typically rectangular in shape. The vending racks commonly include a coin mechanism to release a pivotable door upon inserting a predetermined amount of coins in the coin mechanism. The door provides access into the interior of the vending rack to allow a person to remove a paper. When the door is closed, the coin mechanism locks the door until released again.

Generally, the vending racks have an armored housing made of metal plates. The vending racks are mounted either on a pedestal individually or together in abutting relationship upon a mounting tray or on feet at the bottom to rest upon a support surface. Commonly, newspaper vending racks are placed at strip malls, regional malls and street locations.

One problem with the above vending racks is the theft of the vending racks. These vending racks are typically secured by a separate restraint system such as chains to adjacent immoveable objects or by using weights located in a pan at the bottom of the vending rack. These crude attempts inconvenience but do not deter a determined thief. Additionally, the chains are not architecturally pleasing to the surrounding architectural environment. Another problem with the above vending boxes is the need for a separate structure to support each vending rack. Yet another problem with the above vending racks is that they vary in size, shape, height and width, which detracts from the general appearance of the surrounding environment and are not in concert with the architectural motif intended. A further problem of these vending racks is that they are usually in various stages of deterioration. A still further problem is that these vending racks may not blend in with the surrounding environment.

SUMMARY OF THE INVENTION

It is, therefore, one object of the present invention to provide a vending assembly for vending a plurality of papers from a plurality of publishers.

It is another object of the present invention to incorporate vending boxes as part of architectural landscape forms with more secure attachment to prevent their theft.

It is yet another object of the present invention to provide a more harmonic relationship of vending racks or boxes to the surrounding environment and architecture.

It is another object of the present invention to provide a vending assembly having an architectural landscape form that displays art such as a sculpture, statute, figures or streetscapes.

It is still another object of the present invention to provide a vending assembly which substantially eliminates deterioration.

It is a further object of the present invention to provide a vending assembly which is less expensive to manufacture and assemble.

To achieve the foregoing objects, the present invention is a vending assembly for vending at least one paper from at least one publisher. The assembly includes a mounting frame forming an architectural landscape form providing at least one mounting location. The assembly also includes at least one vending box located at the mounting location. The assembly further includes means for mounting the vending box to the mounting location.

One advantage of the present invention is that the vending assembly incorporates the vending boxes as part of landscape forms with more secure attachment to prevent their theft. Another advantage of the present invention is the elimination-of a separate restraint system such as chains. Yet another advantage of the present invention is that the vending assembly provides a plurality of spaced vending boxes which are aesthetically pleasing and architecturally sound. Another advantage of the present invention is that the mounting frame is an architectural landscape form such as a planter, waste receptacle or bench. Also another advantage is that the mounting frame has a dual use by forming an architectural landscape form that may be a pedestal for displaying art such as a sculpture, statute, figures or streetscapes. Yet another advantage of the present invention is that the vending assembly may be used to display art of a particular region to blend in with the surrounding environment. Still another advantage of the present invention is that the vending assembly is made of either plastic and/or stainless steel to substantially reduce its deterioration. A further advantage of the present invention is that the vending assembly eliminates an armored housing, thereby reducing the cost of manufacture and assembly. Yet a further advantage of the present invention is the elimination of a separate structure to support each vending box by supporting a plurality of vending boxes upon a single mounting frame. A still further advantage of the present invention is that the per unit cost is reduced since multiple vending boxes are supported by one architectural landscape form.

Other objects, features and advantages of the present invention will be readily appreciated as the same becomes better understood after reading the following description in light of the accompanying drawings.

DESCRIPTION OF THE PREFERRED EMBODIMENT(S)

Figure 1:
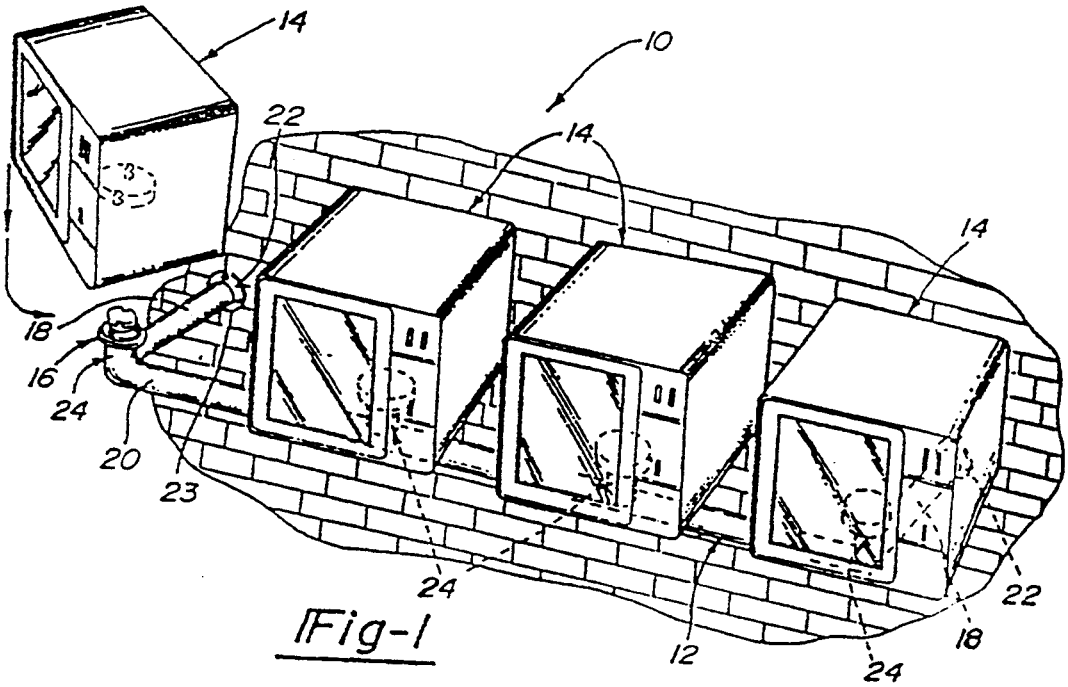
FIG. 1 is a perspective view of a vending assembly according to the present invention.

Referring to FIG. 1, a vending assembly 10, according to the present invention, is shown. The vending assembly 10 is adapted to vend or dispense at least one, preferably a plurality of papers such as newspapers from at least one, preferably a plurality of publishers. The vending assembly 10 includes a mounting frame, generally indicated at 12, adapted to rest upon a support surface such as a wall. The vending assembly 10 also includes, at least one, preferably a plurality of vending boxes or racks, generally indicated at 14, adapted to be supported upon the mounting frame 12. The vending assembly 10 further includes a mounting assembly, generally indicated at 16, to mount and secure the vending boxes 14 to the mounting frame 12.

The mounting frame 12 includes at least one, preferably a plurality of first support members 18 which are spaced longitudinally and orientated generally horizontally. In the preferred embodiment, two (2) first support members 18 are provided. The first support members 18 are interconnected by a second support member 20. The second support member 20 extends longitudinally between the first support members 18. The first and second support members 18 and 20 are generally tubular with a circular cross-section. The first and second support members 20 are preferably made of a metal material such as stainless steel and are secured to each other by suitable means such as welding.

The mounting frame 12 also includes a mounting flange 22 at one end of each first support member 18. The mounting flange 22 is generally a circular plate preferably made of a metal material such as stainless steel and secured to the first support member 18 by suitable means such as welding. The mounting flange 22 is secured to a support surface such as a wall by suitable means such as fasteners 23 to support the weight of the vending boxes 14. It should be appreciated that the first support members 18 extend outwardly a sufficient distance to allow rotation of the vending boxes 14.

The mounting frame 12 further includes at least one, preferably a plurality of mounting locations, generally indicated at 24. The mounting locations 24 are spaced longitudinally along the mounting frame 12. In the preferred embodiment, four (4) mounting locations 24 are provided. Each mounting location 24 is defined by a post 26 and a platform member 28.

The post 26 is orientated generally vertically and extends upwardly from the second support member 20. The post 26 is generally tubular and circular in cross-section. The post 26 is preferably made of a metal material such as stainless steel and is secured to the second support member 20 by suitable means such as welding.

The platform member 28 is generally a circular plate. The platform member 28 is preferably made of a metal material such as stainless steel and secured to an upper end of the post 26 by suitable means such as welding. The platform member 28 may include a plurality of fastener openings 30 which may be threaded to engage threaded fasteners 31. It should be appreciated that the mounting frame 12 may be made of any suitable material such as plastic. It should also be appreciated that the first and second support members 18 and 20, post 26 and platform member 28 may have any suitable shape or cross-section. It should further be appreciated that the mounting frame 12 may be adapted to rest upon a support surface such as a floor.

Figure 2:
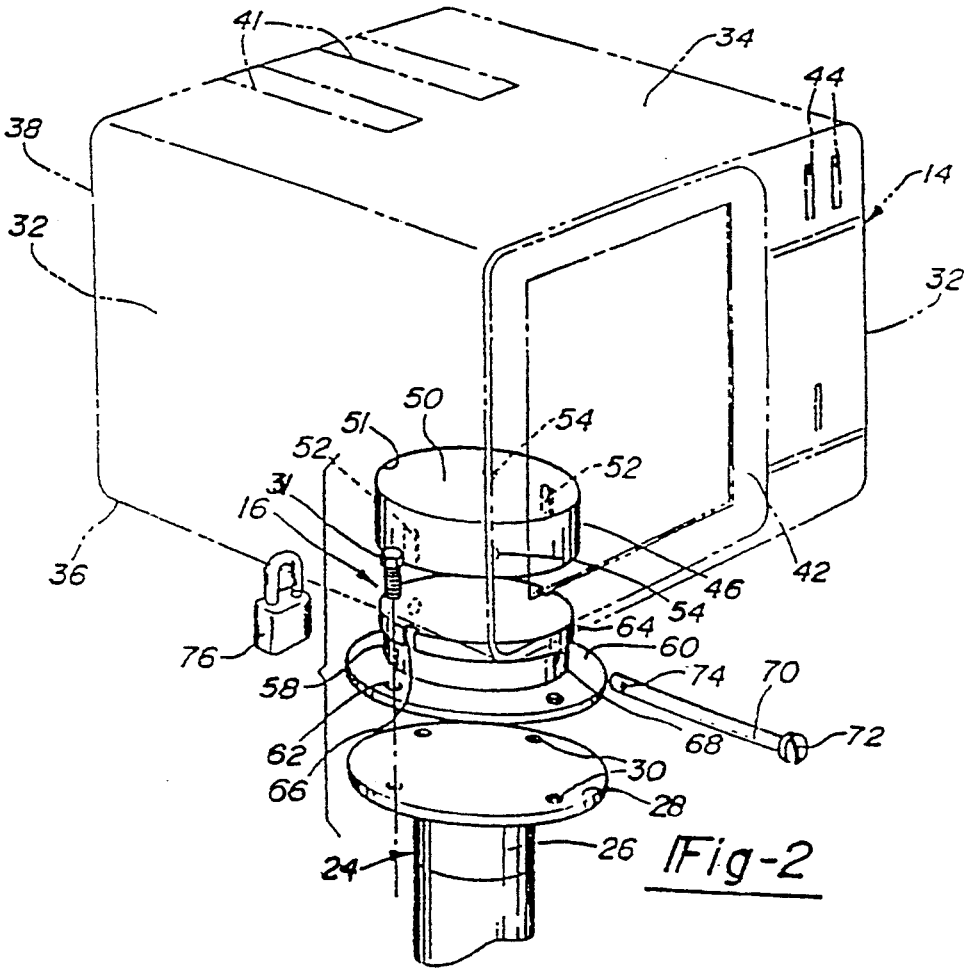
FIG. 2 is an exploded perspective view of a portion of the vending assembly of FIG. 1.
Figure 9:
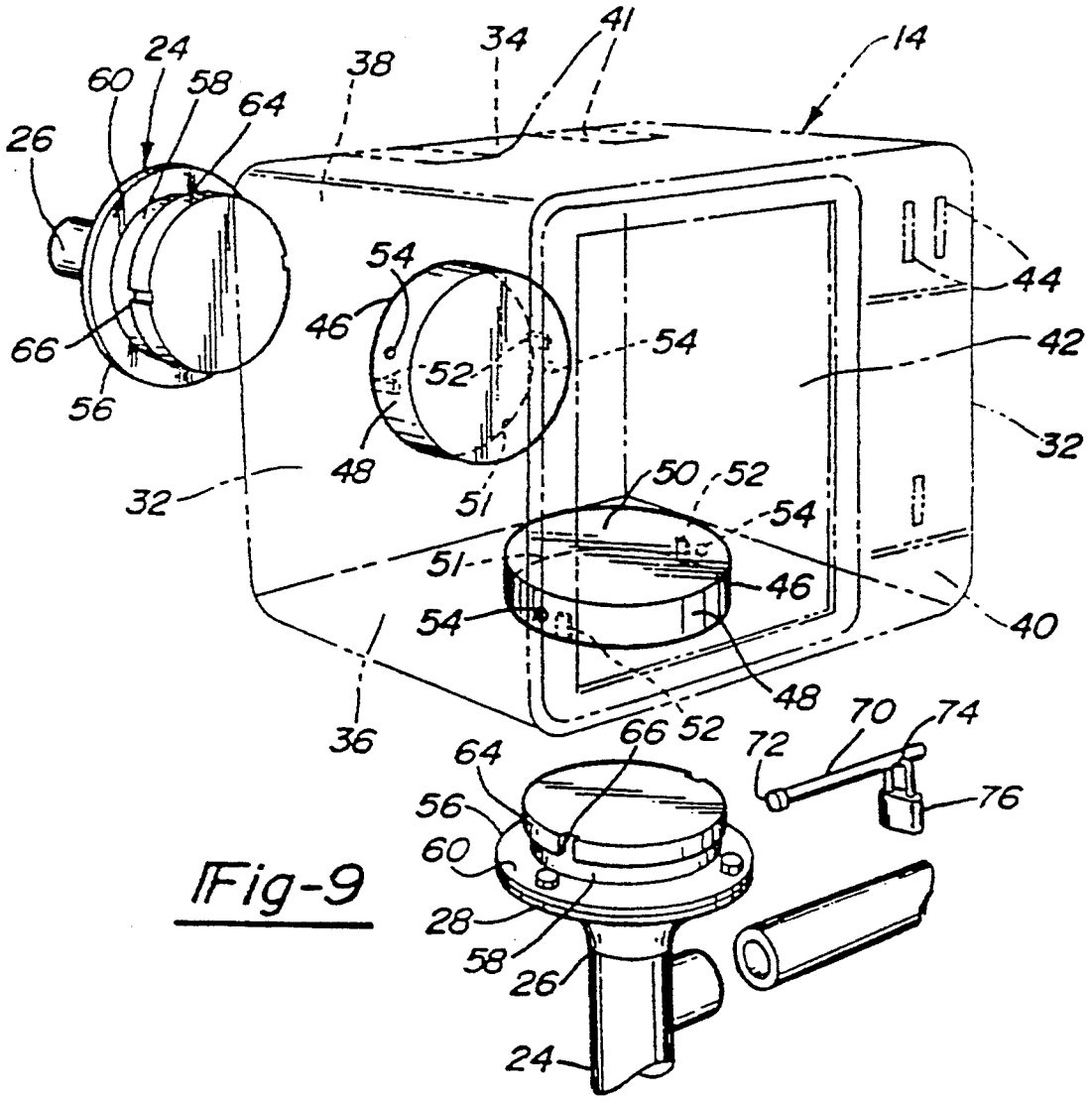
FIG. 9 is an exploded perspective view of a vending box and mounting assembly of FIGS. 1 and 2.

Referring to FIGS. 1, 2 and 9, the vending box 14 is generally rectangular in shape and is defined by side walls 32, top wall 34, bottom wall 36, back wall 38 and front wall 40. The walls 32, 34, 36, 38 and 40 may include drainage slots 41 extending inwardly to provide rigidity to the walls. The front wall 40 includes a door 42 pivotally connected by suitable means to allow access to the interior thereof. The door 42 may include a handle (not shown). The vending box 14 also includes a coin mechanism 44 to release and lock the door 42 when a predetermined amount of coins are placed therein to allow and prevent access into the interior of the vending box 14. Such a coin mechanism 44 is disclosed in a pending application, U.S. Ser. No. 08/049,013, filed Apr. 16, 1993, entitled "Method and Apparatus for Electrically Recognizing and Counting Coins", by inventor Robert W. Baughman, the disclosure of which is hereby incorporated by reference.

Preferably, the vending box 14 is made of a suitable material such as stainless steel or plastic. In the preferred embodiment, the vending box 14 is made of a plastic material such as polyethylene. The vending box 14 may be formed by any suitable method such as rotational molding.

The mounting assembly 16 is preferably of a bayonet type lock. An example of a bayonet type lock may be found in U.S. Pat. No. 4,021,145 to Pepper. The mounting assembly 16 includes a locking member 46. The locking member 46 has an annular side wall 48 and circular bottom wall 50. The side wall 48 and bottom wall 50 define a generally circular cavity 51. The locking member 46 also includes a pair of projections 52 extending inwardly from the side wall 48 into the cavity 51. The projections 52 are generally rectangular in shape. The locking member 46 further includes a pair of opposed apertures 54 extending through the side wall 48. Preferably, the locking member 46 is made of a plastic material. The locking member 46 may be disposed on the bottom wall 36 for a bottom mount type or on the back wall 38 for a rear mount type. In the preferred embodiment, the locking member 46 is integral with either or both the back wall 38 and bottom wall 36 and extends inwardly into the interior of the vending box 14.

The mounting assembly 16 also includes a receiver member 56 adapted to cooperate with the locking member 46. The receiver member 56 is generally circular in shape and has an annular side wall 58 with a mounting flange 60 extending radially outwardly at one end. The mounting flange 60 includes a plurality of apertures 62 spaced circumferentially and extending therethrough. The mounting flange 60 is adapted to rest upon the platform member 28 such that the apertures 62 and 30 are aligned. A plurality of fasteners 31 such as bolts extend through the apertures 62 and 30 to secure the receiver member 56 to the platform member 28.

The receiver member 56 includes a retaining flange 64 extending radially outwardly at the other end thereof. The retaining flange 64 includes a pair of opposed slots 66 extending therethrough. The slots 66 are generally rectangular in shape and have a width slightly greater than the projections 52. The side wall 58 includes a pair of opposed apertures 68 extending through the side wall 58. The mounting assembly 16 also includes a locking pin 70 having an enlarged head 72 at one end and an aperture 74 extending diametrically therethrough near the outer end. A lock 76 such as a padlock is adapted to extend through the aperture 74. The locking pin 70 and receiver member 56 are preferably made of a metal material such as stainless steel. It should be appreciated that the receiver member 56 may be made of any suitable material such as plastic.

In operation, the mounting frame 12 is located upon a support surface. The receiver member 56 is secured by fasteners 31 to the platform member 28 at each mounting location 24. The vending box 14 is orientated such that the projections 52 are aligned with the slots 66. The vending box 14 is moved toward the mounting location 24 until the locking member 46 is disposed about the receiver member 56 such that the projections 52 extend through the slots 66 and are disposed below the retaining flange 64. The vending box 14 is then rotated until the apertures 54 are aligned with the apertures 68. The locking pin 70 is extended through the apertures 54 and 68 until the aperture 74 is past the side wall 48. The lock 76 is extended through the aperture 74 and secured in place. The operation may be reversed to remove the vending box 14 from the mounting location 24.

Accordingly, the interior of each vending box 14 is stacked with papers such as newspapers from one or more publishers. An operator places a predetermined amount of coins in the coin mechanism 44. As a result, the door 42 is released and pivoted outwardly to remove a paper. The door is then rotated to its original position and locked by the coin mechanism 44. The operation may be repeated.

Figure 3:
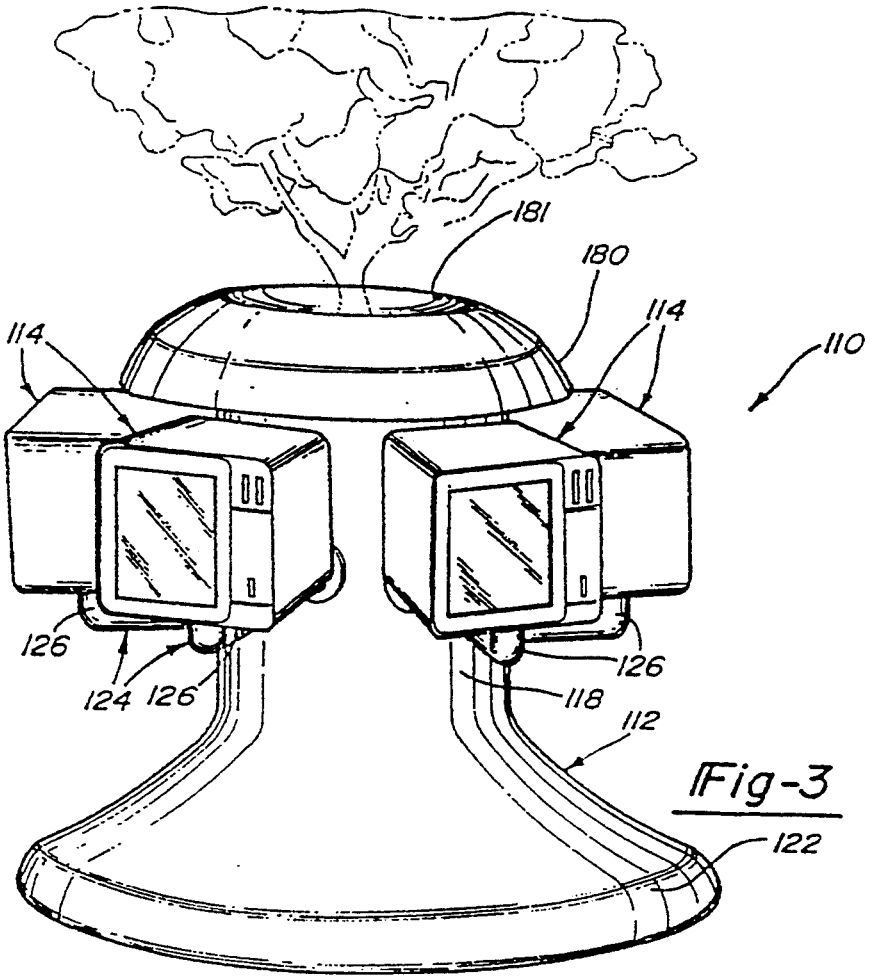
FIG. 3 is a perspective view of a first alternate embodiment of the vending assembly of FIGS. 1 and 2.
Figure 4:
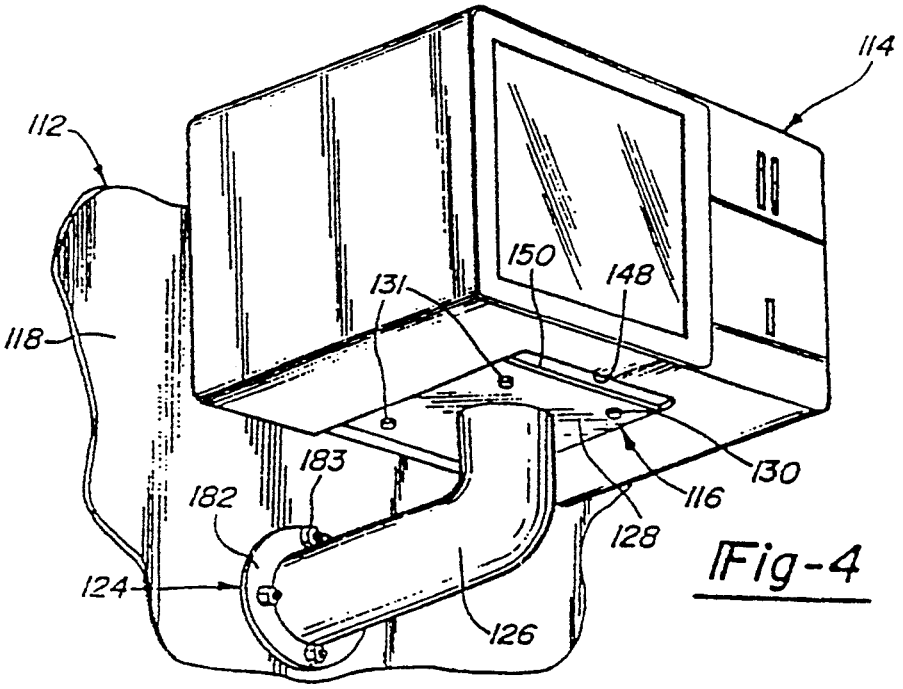
FIG. 4 is a perspective view of a portion of the vending assembly of FIG. 3.

Referring to FIGS. 3 and 4, a first alternate embodiment of the vending assembly 10 is shown. Like parts of vending assembly 10 have like numerals increased by one hundred (100). The vending assembly 110 includes a mounting frame 112 forming a free-standing architectural landscape form. The mounting frame 112 has one first support member 118 and mounting flange 122 at a lower end thereof and a flange 180 at an upper end thereof. The mounting flange 122 is adapted to rest upon a support surface such as a floor. The first support member 118, mounting flange 122 and flange 180 are preferably integral and define a generally circular shape. Preferably, the mounting frame 112 is made of a plastic material. The mounting frame 112 defines a central cavity 181 which may be used as a planter for a plant such as a tree or a waste receptacle, etc. The mounting frame 112 may be filled with any suitable material such as sand to provide the mounting frame 112 with a predetermined weight to be substantially immoveable. It should be appreciated that the mounting frame 112 is of a sufficient size to prevent tipping.

The vending assembly 110 includes a plurality of vending boxes 114 spaced circumferentially about the mounting frame 112 at the mounting locations 124. The post 126 is generally L-shaped and has the platform member 128 at the end of a generally vertical portion and an end flange 182 at the end of a generally horizontal portion. The end flange 182 is secured to the first support member 118 by suitable means such as fasteners 183. The fasteners 183 are preferably bolts extending through the wall of the first support member 118 and end flange 182 and engaged by nuts. The post 126 supports the vending boxes 114 in a cantilevered manner relative to the mounting frame 112. Preferably, the post 126 is made of a metal material such as stainless steel. It should be appreciated that the post 126 may be made of any suitable material such as plastic.

The platform member 128 is preferably generally rectangular in shape and made of a metal material such as stainless steel. The mounting assembly 116 is of a bottom mount type and eliminates the receiver member. The locking member includes side wall and bottom wall forming a generally rectangular cavity. The platform member 128 is disposed within the cavity. The fasteners 131 extend through the apertures 130 of the platform member 128 and corresponding apertures (not shown) in the bottom wall of the locking member. The fasteners 131 are preferably bolts with nuts threadably engaged thereon. It should be appreciated that the mounting assembly 116 may be of the bayonet type of FIGS. 1, 2 and 9 and that the post 126 extends outwardly a sufficient distance to allow rotation of the vending boxes 114.

Figure 5:
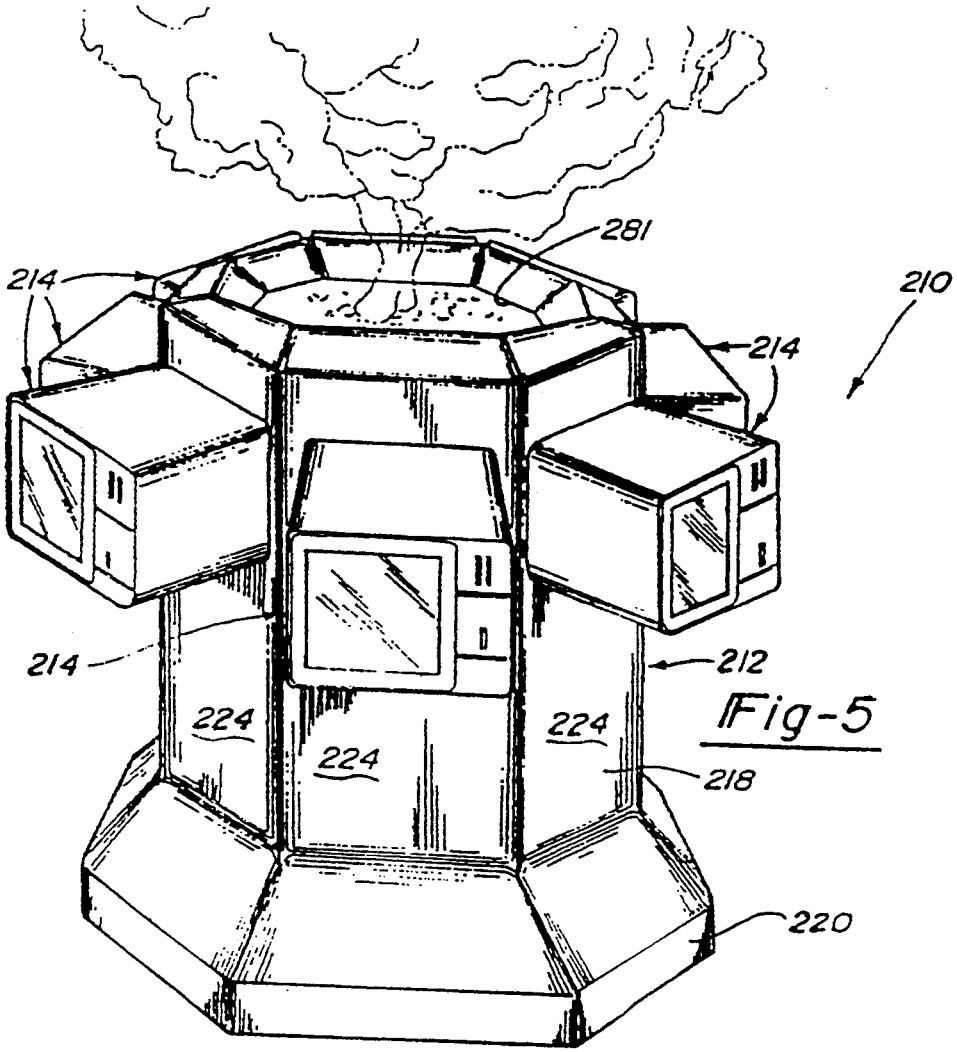
FIG. 5 is a perspective view of a second alternate embodiment of the vending assembly of FIGS. 1 and 2.
Figure 6:
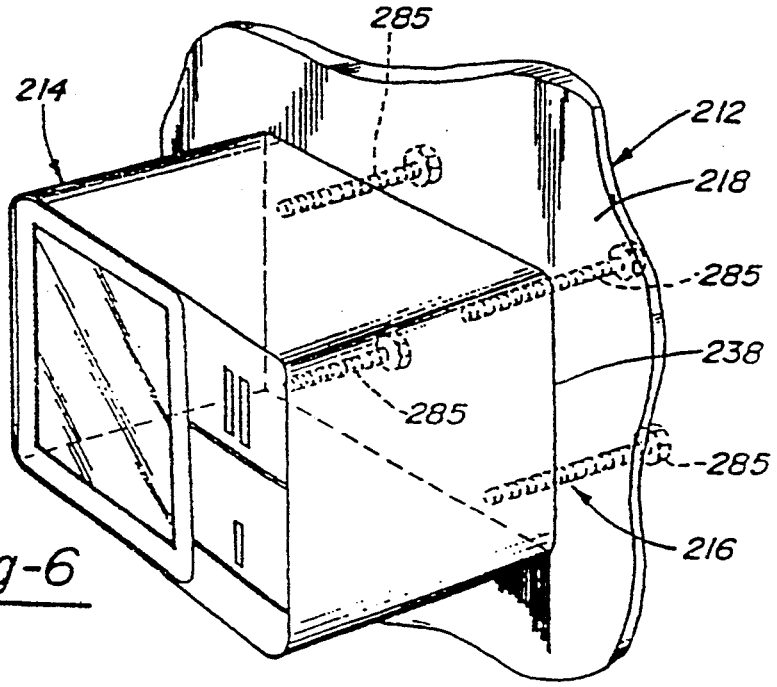
FIG. 6 is a perspective view of a portion of the vending assembly of FIG. 5.

Referring to FIGS. 5 and 6, a second alternate embodiment of the vending assembly 10 is shown. Like parts have like numerals increased by two hundred (200). The vending assembly 210 includes a mounting frame 212 forming a free-standing architectural landscape form. The mounting frame 212 has one first support member 218 and a mounting flange 220 at a lower end thereof. The first support member 218 and mounting flange 220 are preferably integral and define a generally circular shape. The mounting frame 212 has a plurality of mounting locations 224 defined as generally planar and vertical surfaces on the first support member 218. Preferably, the mounting frame 212 is made of a plastic material. The mounting frame 212 defines a central cavity 281 which may be used as a planter for a plant such as a tree or a waste receptacle, etc. The mounting frame 212 may be filled with any suitable material such as sand to provide the mounting frame 212 with a predetermined weight to be substantially immoveable. It should be appreciated that the mounting frame 212 is of a sufficient size to prevent tipping.

The mounting assembly 216 is of a back or rear mount type and eliminates the locking member and receiver member. The mounting assembly 216 includes a plurality of fasteners 285 extending through apertures (not shown) in the back wall 238 of the vending box 214. The fasteners 285 are preferably bolts with nuts threadably engaged thereon. It should be appreciated that the back wall 238 is planar to abut the planar surface of the mounting location 224. It should also be appreciated that the mounting assembly 216 may be of the bayonet type or cantilevered type and that the mounting locations 224 are spaced a sufficient distance to allow rotation of the vending boxes 214.

Figure 7:
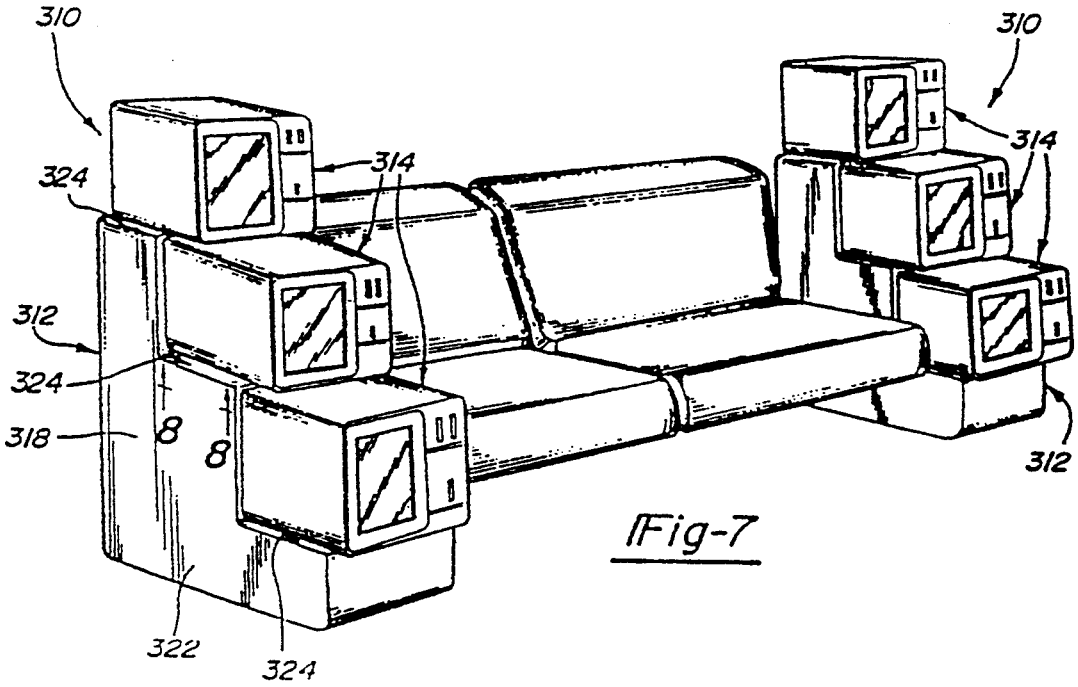
FIG. 7 is a perspective view of a third alternate embodiment of the vending assembly of FIGS. 1 and 2.
Figure 8:
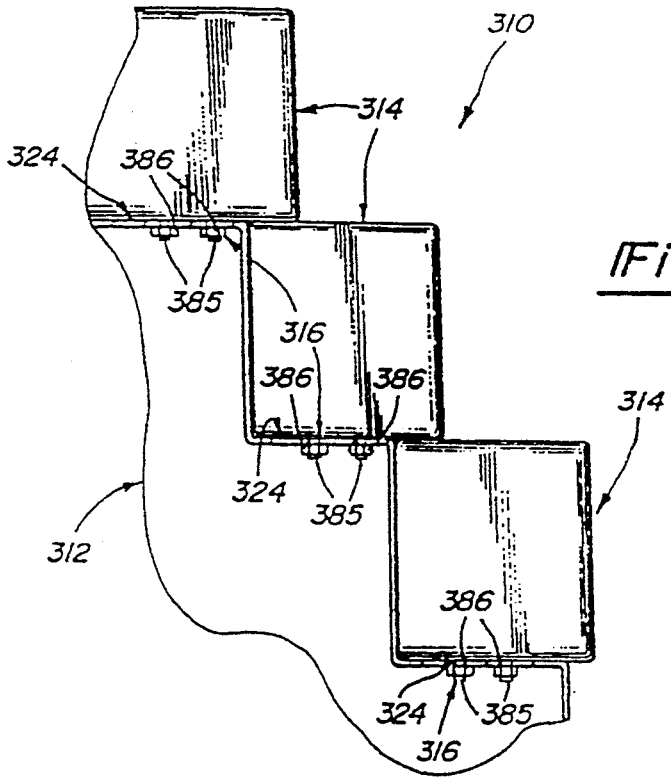
FIG. 8 is a partial fragmentary elevational view of a portion of the vending assembly of FIG. 7.

Referring to FIGS. 7 and 8, a third alternate embodiment of the vending assembly 10 is shown. Like parts of vending assembly 10 have like numerals increased by three hundred (300). The vending assembly 310 includes a mounting frame 312 forming a free-standing architectural landscape form. The mounting frame 312 is generally rectangular in shape and has an overall stair-step shape. The mounting frame 312 has one first support member 318 and a mounting flange 322 at a lower end thereof. Preferably, the first support member 318 and mounting flange 322 are integral and made of a plastic material. The mounting frame 312 includes a plurality of mounting locations 324 formed as generally planar and horizontal surfaces. The mounting locations 324 provide a bottom mount for the vending boxes 314. The mounting frame 312 may include an opening (not shown) to allow the interior to be filled with any suitable material such as sand to provide the mounting frame 312 with a predetermined weight to be substantially immovable. It should be appreciated that the mounting frame 312 is of a sufficient size to prevent tipping. It should also be appreciated that the mounting frame 312 may incorporate a bench and be provided at each end to act as an arm rest.

In the preferred embodiment, three (3) mounting locations 324 are provided. The vending assembly 312 includes a plurality of vending boxes 314 stacked partially upon and overlapping each other at the mounting locations 324. The mounting assembly 316 includes a plurality of fasteners 385 extending through the bottom wall 350 of the vending box 314 and the mounting frame 312. The fasteners 385 are preferably bolts engaged by nuts 386. It should be appreciated that the mounting assembly 316 may be of the bayonet type and that the mounting locations 324 are spaced a sufficient distance to allow rotation of the vending boxes 314.

Figure 10:
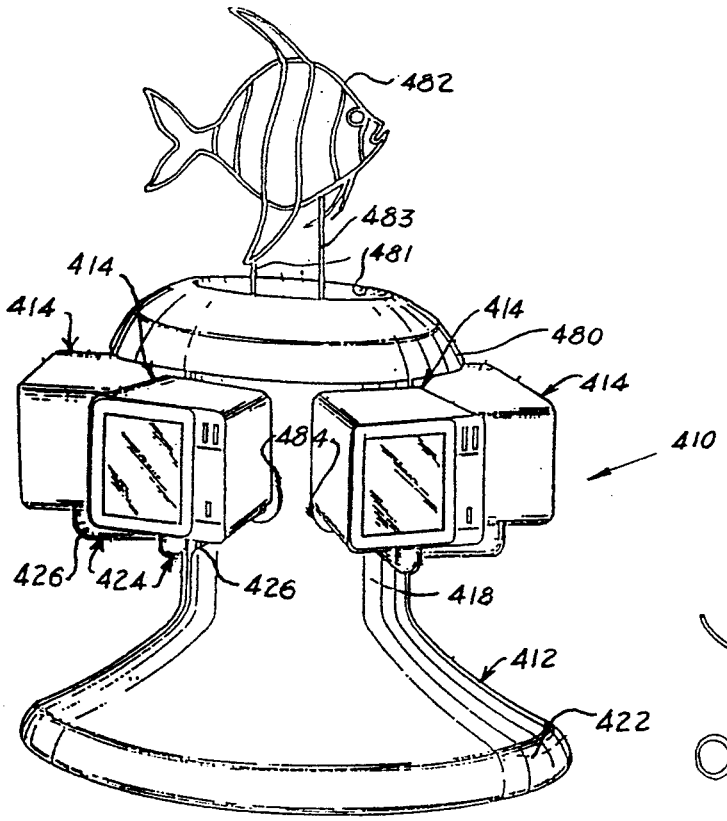
FIG. 10 is a perspective view of a fourth alternate embodiment of the vending assembly of FIGS. 1 and 2.

Referring to FIG. 10, a fourth alternate embodiment of the vending assembly 10 is shown. Like parts of vending assembly 10 have like numerals increased by four hundred (400). The vending assembly 410 includes a mounting frame 412 forming a free-standing architectural landscape form such as a pedestal or platform for mounting and/or displaying art. The mounting frame 412 has one first support member 418 and mounting flange 422 at a lower end thereof and a flange 480 at an upper end thereof. The mounting flange 422 is adapted to rest upon a support surface such as a floor. The first support member 418, mounting flange 422 and flange 480 are preferably integral and define a generally circular shape. Preferably, the mounting frame 412 is made of a plastic material. The mounting frame 412 includes a platform member 481 which forms a central cavity which may be used to mount and/or display art 482 such as a sculpture, statute, figure, abstract design, streetscape, etc. In this embodiment, the art 482 is a figure of a fish made of wire and has two generally vertical members 483 connected to a plate member (not shown) which is attached to the platform member 481 by suitable means such as fasteners (not shown). The mounting frame 412 may be filled with any suitable material such as sand to provide the mounting frame 412 with a predetermined weight to be substantially immoveable. It should be appreciated that the mounting frame 412 is of a sufficient size to prevent tipping.

The vending assembly 410 includes a plurality of vending boxes 414 spaced circumferentially about the mounting frame 412 at the mounting locations 424. The post 426 is generally L-shaped and has the platform member 428 at the end of a generally vertical portion and an end flange 484 at the end of a generally horizontal portion. The end flange 484 is secured to the first support member 418 by suitable means such as fasteners (not shown). The fasteners are preferably bolts extending through the wall of the first support member 418 and end flange 484 and engaged by nuts. The post 426 supports the vending boxes 414 in a cantilevered manner relative to the mounting frame 412. Preferably, the post 426 is made of a metal material such as stainless steel. It should be appreciated that the post 426 may be made of any suitable material such as plastic. It should also be appreciated that the vending boxes 414 are mounted to the posts 426 similar to that for the vending assembly 110.

Figure 11:
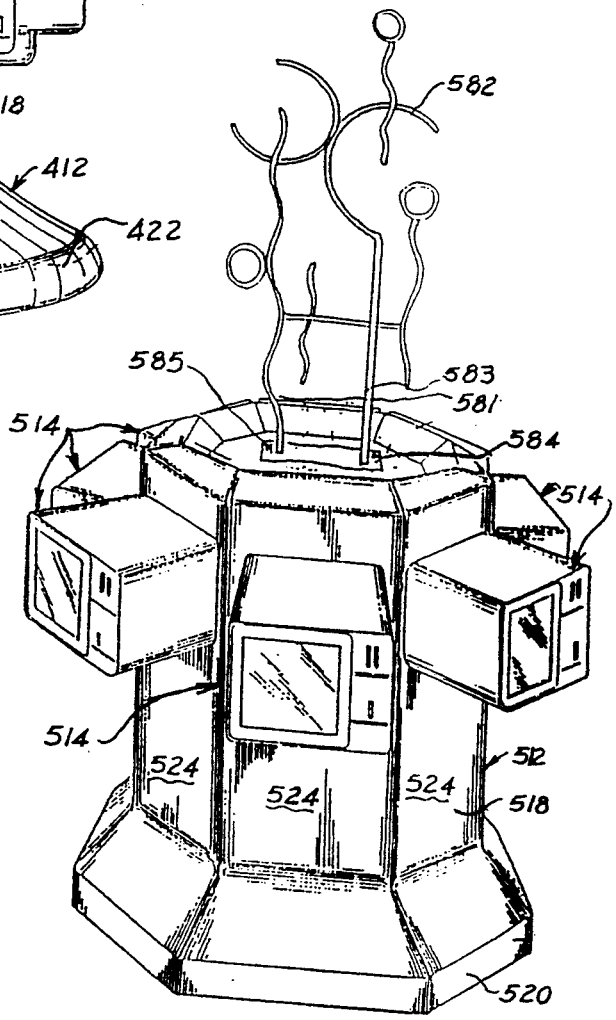
FIG. 11 is a perspective view of a fifth alternate embodiment of the vending assembly of FIGS. 1 and 2.

Referring to FIG. 11, a fifth alternate embodiment of the vending assembly 10 is shown. Like parts have like numerals increased by five hundred (500). The vending assembly 510 includes a mounting frame 512 forming a free-standing architectural landscape form such as a pedestal or platform for mounting and/or displaying art. The mounting frame 512 has one first support member 518 and a mounting flange 520 at a lower end thereof. The first support member 518 and mounting flange 520 are preferably integral and define a generally circular shape. The mounting frame 512 has a plurality of mounting locations 524 defined as generally planar and vertical surfaces on the first support member 518. Preferably, the mounting frame 512 is made of a plastic material. The mounting frame 512 includes a platform member 581 which forms a central cavity which may be used to mount and/or display art 582 such as a sculpture, statute, figure, abstract design, streetscape, etc.

In this embodiment, the art 582 is an abstract design made of wire and has two generally vertical members 583 connected to a plate member 584 which is attached to the platform member 581 by suitable means such as fasteners 585. The mounting frame 512 may be filled with any suitable material such as sand to provide the mounting frame 512 with a predetermined weight to be substantially immoveable. It should be appreciated that the mounting frame 512 is of a sufficient size to prevent tipping.

The vending assembly 510 includes a plurality of vending boxes 514 spaced circumferentially about the mounting frame 512 at the mounting locations 524. It should be appreciated that the vending boxes 514 are mounted to the mounting frame 512 similar to that for the vending assembly 210.

Accordingly, the vending assembly is of a sufficient size to reduce theft of the entire assembly. Also, the vending assembly is made of either stainless steel, plastic or both to substantially reduce deterioration. Further, the mounting frame is preferably made as an aesthetically pleasing and immovable, free-standing architectural landscape form such as a planter, waste receptacle, bench or pedestal that displays art such as a sculpture, statute, abstract design, figure or streetscape that blends in with the surrounding environment.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. An ornamental vending assembly for vending at least one newspaper from at least one publisher, comprising:

a mounting frame having a dual use by forming a substantially immovable free standing architectural landscape form comprising a pedestal for art and providing a plurality of spaced mounting locations;

a plurality of spaced apart vending boxes detachably mounted to the mounting frame, each being located at a corresponding one of said spaced mounting locations, at least one of said vending boxes being a vending box for at least one newspaper from at least one publisher; and means for mounting each one of said vending boxes to said mounting frame at one of said mounting locations.

2. A vending machine as set forth in claim 1 wherein the art is one from the group consisting of a figure, statue, abstract design, streetscape and sculpture.

3. An ornamental vending assembly for vending a plurality of newspapers from vending boxes, comprising:

a mounting frame having a dual use by forming a substantially immovable free standing architectural landscape form comprising a pedestal for art and providing a plurality of spaced mounting locations;

a plurality of spaced apart rectangular shaped vending boxes detachably mounted to said mounting frame, each vending box being located at one of said spaced mounting locations, said vending boxes for vending a variety of newspapers; and means for mounting each of said vending boxes to said mounting frame at one of said mounting locations.

4. The ornamental vending assembly recited in claim 3 wherein each of said vending boxes is spaced circumferentially around and extends outwardly from said mounting frame.

* * * * *